US006561929B2

(12) United States Patent
Watanabe

(10) Patent No.: US 6,561,929 B2
(45) Date of Patent: May 13, 2003

(54) TWO-PIECE GOLF BALL

(75) Inventor: Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/924,764

(22) Filed: Aug. 9, 2001

(65) Prior Publication Data

US 2002/0039934 A1 Apr. 4, 2002

(30) Foreign Application Priority Data

Aug. 15, 2000 (JP) ..... 2000-246114
Sep. 14, 2000 (JP) ..... 2000-279875

(51) Int. Cl.[7] ..... A63B 37/06
(52) U.S. Cl. ..... 473/377
(58) Field of Search ..... 473/377, 378, 473/371, 367, 368

(56) References Cited

U.S. PATENT DOCUMENTS 5,490,673 A * 2/1996 Hiraoka ..... 473/372
5,516,110 A 5/1996 Yabuki et al.
5,562,287 A * 10/1996 Endo et al. ..... 273/377
5,645,496 A 7/1997 Endo et al.
5,776,012 A * 7/1998 Moriyama et al. ..... 473/372
5,803,833 A * 9/1998 Nakamura et al. ... 273/DIG. 20
6,319,154 B1 * 11/2001 Yoshida et al. ..... 473/377
6,386,993 B1 * 5/2002 Yokota ..... 473/373

FOREIGN PATENT DOCUMENTS

| | | | |
|---|---|---|---|
| GB | 2338421 | * 12/1999 | ..... A63B/37/00 |
| JP | 6-98949 | 4/1994 | |
| JP | 3040300 | 8/1995 | |
| JP | 10-127823 | 5/1998 | |
| JP | 11-290479 | * 10/1999 | ..... A63B/37/00 |
| JP | 2000-5341 | 1/2000 | |

* cited by examiner

*Primary Examiner*—Mark S. Graham
*Assistant Examiner*—Reann Gordon
(74) *Attorney, Agent, or Firm*—Sughrue Mion, PLLC

(57) ABSTRACT

A two-piece golf ball includes a core and a cover. The core is made from a rubber composition containing a base rubber to which an organic sulfur compound is mixed in an amount of 0.05 part by mass or more on the basis of 100 parts by mass of said base rubber. The JIS-C hardness, measured by a JIS-C hardness tester, of the center of said core is in a range of 40 to 60 and the JIS-C hardness of the surface of said core is in a range of 70 to 85, and further, a difference in JIS-C hardness between the core surface and the core center (hardness of core surface−hardness of core center) is in a range of 20 to 27. The compressive deformation amount, which is measured by applying, to said core, a load from an initial load of 10 kgf (98.07 N) to a final load of 130 kgf (1274.91 N), is in a range of 3.5 to 4.6 mm. The thickness of said cover is in a range of 1.8 to 2.3 mm. With this configuration, it is possible to further increase the flying distance of the ball without impairing the feeling of hitting the ball and the durability against cracking.

7 Claims, 1 Drawing Sheet

TWO-PIECE GOLF BALL

BACKGROUND OF THE INVENTION

The present invention relates to a two-piece golf ball including a core made from a rubber-like elastic body and a cover formed to cover the core, and particularly to a two-piece golf ball capable of increasing the flying distance of the ball without impairing both the feeling of hitting the ball and the durability of the ball.

In general, two-piece golf balls, which are capable of increasing the flying distance of the ball and prolonging the durability of the ball as compared with thread-wound type golf balls, have been widely used for golfers.

A two-piece golf ball, however, is different from a thread-wound type golf ball having been accustomed for a long time by golfers, in terms of feeling of hitting the ball. Accordingly, the technique of improving a two-piece golf ball from the viewpoint of feeling of hitting the ball has been successively examined.

For example, Japanese Patent No. 3040300 has proposed a two-piece golf ball, wherein the feeling of hitting the ball is improved to a level comparable to that of a thread-wound type golf ball.

On the other hand, the golfer's demand to increase the flying distance of a golf ball has been strong yet, and therefore, although two-piece golf balls are capable of increasing the flying distance of the ball as compared with thread-wound type golf balls, it is expected to develop a two-piece golf ball capable of further increasing the flying distance of the ball.

Various kinds of two-piece golf balls improved in feeling of hitting the ball have been proposed, for example, in the above-described document, Japanese Patent No. 3040300; however, these two-piece golf balls each fail to take a good balance against other performances as described below.

For example, with respect to the two-piece golf ball proposed in Japanese Patent No. 3040300, the feeling of hitting the ball becomes softer than that of a conventional ball; however, the cover is not particularly specified except for the thickness of the cover, which is described to be preferably in a range of 1.4 mm to 2.7 mm and to be set to 1.6 mm in each of the disclosed embodiments. With such a thickness of the cover, it is difficult to improve both the durability and the flying performance of the ball, and particularly, in consideration of a difference in JIS-C hardness between the core surface and the core center, which is described to be preferably in a range of 28 to 34, it becomes probably very insufficient to improve the durability against cracking of the ball as well as the flying performance of the ball, and further there is a problem associated with a composition of a material for obtaining such a core.

SUMMARY OF THE INVENTION

In view of the foregoing, the present invention has been made, and an object of the present invention is to provide a two-piece golf ball capable of increasing the flying distance of the ball without impairing both the feeling of hitting the ball and the durability of the ball.

To achieve the above object, the present inventor has earnestly studied a two-piece golf ball having a core and a cover on a difference in JIS-C hardness between the core surface and the core center and the compressive deformation amount of the core in a specified range, and on the thickness of the cover formed to cover the core.

The present inventor has eventually found that a two-piece golf ball including a core and a cover, which is characterized in the following points (1) to (4), is surprisingly excellent in either of the flying performance of the ball, the feeling of hitting the ball, and the durability of the ball, and that the golf ball particularly exhibits a flying performance sufficiently acceptable to golfers at the level of low/intermediate head speeds (about 35 to 40 m/s).

(1) The core is made from a rubber composition containing a base rubber to which an organic sulfur compound is mixed in an amount of 0.05 part by mass or more on the basis of 100 parts by mass of said base rubber;

(2) the JIS-C hardness, measured by a JIS-C hardness tester, of the center of said core is in a range of 40 to 60 and the JIS-C hardness of the surface of said core is in a range of 70 to 85, and further, a difference in JIS-C hardness between the core surface and the core center (hardness of core surface−hardness of core center) is in a range of 20 to 27;

(3) the compressive deformation amount, which is measured by applying, to said core, a load from an initial load of 10 kgf (98.07 N) to a final load of 130 kgf (1274.91 N), is in a range of 3.5 to 4.6 mm; and (4) the thickness of said cover is in a range of 1.8 to 2.3 mm.

Accordingly, the present invention provides a two-piece golf ball including a core and a cover, wherein said core is made from a rubber composition containing a base rubber to which an organic sulfur compound is mixed in an amount of 0.05 part by mass or more on the basis of 100 parts by mass of said base rubber; the JIS-C hardness, measured by a JIS-C hardness tester, of the center of said core is in a range of 40 to 60 and the JIS-C hardness of the surface of said core is in a range of 70 to 85, and further, a difference in JIS-C hardness between the core surface and the core center (hardness of core surface−hardness of core center) is in a range of 20 to 27; the compressive deformation amount, which is measured by applying, to said core, a load from an initial load of 10 kgf (98.07 N) to a final load of 130 kgf (1274.91 N), is in a range of 3.5 to 4.6 mm; and the thickness of said cover is in a range of 1.8 to 2.3 mm.

In this two-piece golf ball, preferably, the cover is made from a material containing a main resin to which an inorganic granular filler is mixed as a reinforcing material in an amount of 11 parts by mass or more on the basis of 100 parts by mass of said main resin.

With these configurations of the two-piece golf ball, it is possible to further increase the flying distance of the ball without impairing the feeling of hitting the ball and the durability of the ball.

DETAILED DESCRIPTION OF THE PREFERRED EMBODIMENTS

Figure 1:
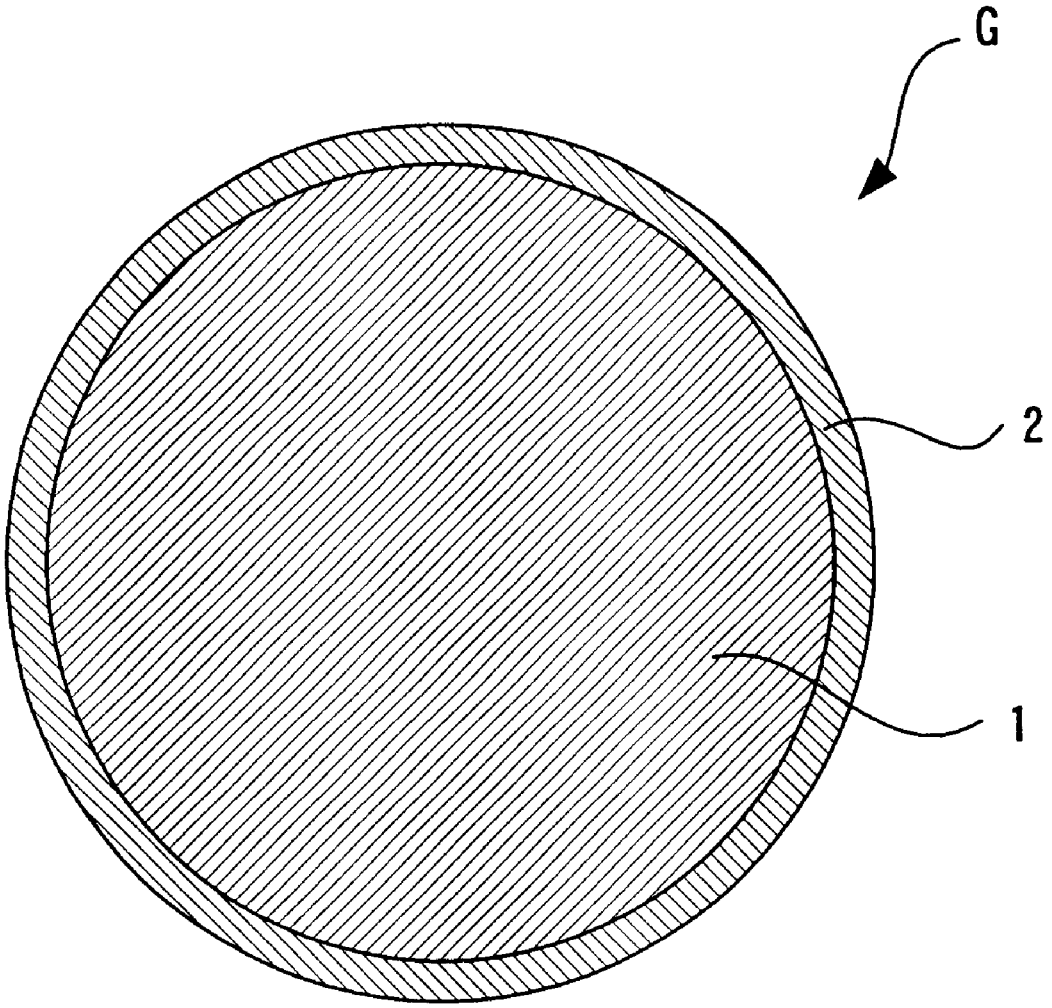
FIG. 1 shows a sectional view of a golf ball of the present invention having a core and a cover.

Referring to FIG. 1, a two-piece golf ball G having a core 1 and cover 2 of the present invention will be described in further detail. The two-piece golf ball of the present invention includes a core made from a rubber composition which mainly contains a base rubber. As the base rubber, there may be used a known natural rubber or synthetic rubber, more specifically, polybutadiene, particularly, 1,4-cis-polybutadiene having at least 40% or more of a cis-structure.

The base rubber may further contain a natural rubber, polyisoprene rubber, styrene-butadiene rubber, in addition to the above-described synthetic rubber, that is, polybutadiene, as needed.

According to the present invention, to give a desirable resilience to the core, an organic sulfur compound must be added to the base rubber. As the organic sulfur compound, there may be used thiophenol, thionaphthol, halogenated thiophenol, or a metal salt thereof. Specific examples of the organic sulfur compounds may include zinc salts of pentachlorothiophenol, pentafluorothiophenol, pentabromothiophenol, parachlorothiophenol, and pentachlorothiophenol; and polysulfides each having the sulfur number of 2 to 4, such as diphenyl polysufide, dibenzil polysulfide, dibenzoyl polysulfide, dibenzothiazoyl polysulfide, and dithiobenzoyl polysulfide. In particular, a zinc salt of pentachlorothiophenol or diphenyldisulfide is preferably used.

According to the present invention, the added amount of the organic sulfur compound is generally in a range of 0.05 part by mass or more, preferably, 0.1 part by mass or more, more preferably, 0.2 part by mass or more on the basis of 100 parts by mass of the base rubber. If the added amount is excessively small, the effect of improving the resilience cannot be expected. The upper limit of the added amount of the organic sulfur compound is generally in a range of 2.0 parts by mass or less, preferably, 1.2 parts by mass or less, more preferably, 1.0 part by mass on the basis of 100 parts by mass of the base rubber. If the added amount of the organic sulfur compound is excessively large, the effect of improving the resilience (particularly, at the time of hitting the golf ball with the driver (or number one wood (W#1)) cannot be expected so much, and the core is excessively softened to degrade the feeling of hitting the ball.

In addition to the above-described base rubber and the organic sulfur compound, known components may be added to the rubber composition of the present invention, as needed. Examples of the known components may include zinc salts of unsaturated carboxylic acids, organic peroxides, and antioxidants. The added amount of the above known component is not particularly limited.

The core can be produced from the above-described rubber composition for the core in accordance with a known process. One example of the process of producing the core includes the steps of kneading the rubber composition by a Banbury mixer or kneader into a slug, putting the slug into a specific mold, and heating the slug at a temperature of generally 150° C. to 190° C., preferably, 160° C. to 180° C. for a vulcanizing time of 8 min to 20 min, preferably, 12 min to 16 min.

The core of the present invention is required to be adjusted such that the hardness of each of the core surface and the core center, measured by a JIS-C hardness tester, are specified, and further, a difference in JIS-C hardness between the core surface and the core center is set to a specific value.

To be more specific, the JIS-C hardness of the core center is specified to be generally in a range of 40 to 60, preferably, 52 to 58. If the JIS-C hardness of the core center is excessively high, the feeling of hitting the golf ball with the driver becomes excessively hard, and accordingly, the spin of the hit ball becomes large to degrade the flying performance, thereby failing to ensure a sufficient flying performance of the ball. If the JIS-C hardness of the core center is excessively low, the feeling of hitting the golf ball with the driver becomes excessively soft, the durability against cracking is degraded, and the resilience of the ball becomes excessively small, thereby failing to achieve the object of increasing the flying distance of the ball.

The JIS-C hardness of the core surface is specified to be generally in a range of 70 to 85, preferably, 77 to 82. In particular, if the JIS-C hardness of the core surface is set to 77 or more, it is possible to significantly improve the feeling of hitting the golf ball with the driver. On the contrary, if the JIS-C hardness of the core surface is excessively low, the feeling of hitting the ball with the driver becomes excessively soft, the durability against cracking of the ball is degraded, and the resilience of the ball is lowered to degrade the flying performance of the ball, and further, if the JIS-C hardness of the core surface is excessively high, the feeling of hitting the ball with the driver or putter becomes excessively hard.

The difference in JIS-C hardness between the core surface and the core center is specified such that the hardness becomes gradually higher from the center to the surface of the ball, preferably, in accordance with a hardness distribution having a rapid gradient within a range to be described later.

The suitable adjustment of the difference in JIS-C hardness between the core surface and the core center is effective to powerfully flying performance of the golf ball with the driver by reducing the spin of the hit ball. The core hardness has such an inconsistent characteristic that if the differential hardness is excessively large as in the prior art, the durability against cracking of the ball is degraded, and if the hardness of the core center is excessively small, the resilience of the ball is degraded. According to the present invention, the differential hardness is adjusted so as to overcome such an inconsistent characteristic of the core hardness.

The difference in JIS-C hardness between the core surface and the core center of the present invention is required to be generally in a range of 20 to 27, preferably, 22 to 25. The differential hardness in this range is optimum to ensure a sufficient durability of the golf ball without lowering the hardness of the core center so much. If the differential hardness is excessively small, the resilience of the ball is degraded, and if the differential hardness is excessively large, the durability against cracking of the ball is degraded.

According to the core of the present invention, not only the JIS-C hardness of each of the core surface and the core center and the difference in JIS-C hardness between the core surface and the core center are specified as described above, but also the compressive deformation amount of the entire core is specified as follows: namely, the compressive deformation amount of the core, measured by applying, to the core, a load from an initial load of 10 kgf (98.07 N) to a final load of 130 kgf (1274.91 N) is required to be in a range of 3.5 mm to 4.6 mm, preferably, 3.8 mm to 4.3 mm. If the compressive deformation amount is excessively small, the feeling of hitting the golf ball is degraded, and the spin of the hit ball becomes excessively large, thereby reducing the flying distance at the time of hitting the ball with the driver. If the compressive deformation amount is excessively large, the feeling of hitting the ball with the driver is degraded, and the resilience of the ball is lowered to degrade the flying performance.

According to the two-piece golf ball of the present invention, the above-described core is covered with a cover which is required to have a specific thickness to be described later. The cover, however, may be made from a known material.

To improve the durability against cracking of the cover, the cover may be made from a thermoplastic resin such as an ionomer resin, preferably, a material mainly containing a thermoplastic resin such as an ionomer resin, for example, "Himilan" (trade name, sold by Du Pont-Mitsui Polychemicals Co., Ltd.), or "Surlyn" (sold by DU PONT DE NEMOURS & COMPANY).

To significantly improve the resilience and the durability against cracking of the golf ball, as the above-described ionomer resin used as the main component of the cover material, there may be used a Zn ion neutralized type ionomer resin and an Na ion neutralized type ionomer resin. The added amount of each of the Zn ion and Na ion neutralized type ionomer resins may be in a range of 20 mass % or more, preferably, 30 mass % or more with the total weight of these ionomer resins taken as 100. If the added amount of each of the Zn ion and Na ion neutralized type ionomer resins is smaller than the above range, the effect of improving the resilience and durability against cracking may be degraded.

The cover of the present invention may be made from a material mainly containing the above-described ionomer resin, to which an inorganic granular filler may be added as a reinforcing material.

As the inorganic granular filler of a reinforcing material, there may be used a barium sulfate.

To improve the dispersibility of the inorganic granular filler, the average particle size thereof may be set, while not limited thereto, in a range of 0.01 to 100 $\mu$m.

According to the present invention, in the case of adding the inorganic granular filler, the added amount thereof is generally in a range of 11 parts by mass or more, preferably, 15 parts by mass or more on the basis of 100 parts by mass of the thermoplastic resin such as the ionomer resin. The cover made from the material containing the inorganic filler as the reinforcing agent is effective to improve, in cooperation with the core, the durability against cracking of the golf ball without lowering the cover hardness, and hence to achieve both the excellent flying performance and durability of the ball. If the added amount of the filler is excessively small, the reinforcing effect may become insufficient. The upper limit of the added amount of the filler is generally in a range of 45 parts by mass or less, preferably, 35 parts by mass or less. If the added amount of the filler is excessively large, the resilience may be degraded.

The two-piece golf ball of the present invention can be produced by covering the above-described core with the above-described cover material in accordance with, for example, a known injection molding process or a known compression molding process. The former process is performed by putting a previously prepared solid core in a mold, and injection-molding a cover material on the surface of the solid core. The latter process is performed by previously preparing a pair of cup halves with a specific cover material, covering a solid core with the cup halves, and pressing the solid core covered with the cup halves. In each process, the molding condition may be suitably changed.

According to the present invention, the thickness of the cover is required to be adjusted so as to obtain a synergistic effect with the improved core of the present invention. To be more specific, the thickness of the cover is required to be generally 1.8 mm to 2.3 mm, preferably, 2.0 mm to 2.2 mm. The cover having such a thickness is effective to enhance, in cooperation with the core having the hardness specified as described above, the flying performance, the durability, and the feeling of hitting the golf ball. If the thickness of the cover is excessively small, the durability against cracking is significantly degraded, and the spin of the ball at the time of hitting the ball with the driver is increased to degrade the flying performance of the ball. If the thickness of the cover is excessively large, the feeling of hitting the ball with the putter becomes excessively hard and also the resilience of the ball is lowered to degrade the flying performance of the ball.

The two-piece golf ball of the present invention exhibits the above-described excellent flying performance, durability, and feeling of hitting the ball widely acceptable to all players without distinction between amateur players and professional players. In particular, since the golf ball of the present invention is clearly superior to the prior art golf ball in terms of flying performance while ensuring the excellent durability against repeated hitting and the desirable feeling of hitting the ball, the golf ball can be suitably used for players at the level of low/intermediate head speeds in a range of about 35 to 40 m/s, who take much account of the flying performance of the ball.

The two-piece golf ball of the present invention can be produced with its diameter and weight adjusted in accordance with the Rules of Golf. That is to say, the golf ball having a diameter of 42.67 mm or more and a weight of 45.93 g or less can be produced.

EXAMPLES

The present invention will be more clearly understood by way of, while not limited thereto, the following Examples and Comparative Examples.

Examples 1 to 3 and Comparative Examples 1 to 8

Two-piece golf balls were produced using core materials and cover materials shown in Table 1 in accordance with a known process. With respect to each of the inventive golf balls, the core is adjusted such that the compressive deformation amount, the JIS-C hardness of each of the core surface and the core center, and the difference in JIS-C hardness between the core surface and the core center are in the ranges specified by the present invention, respectively, and that the core contains an organic sulfur compound (zinc salt of pentachlorothiophenol or diphenyl disulfide); and the cover is obtained by injection-molding the cover material described in Table 1 into a thickness in the range specified by the present invention. The composition and physical properties of the cover, and the composition, vulcanizing condition, and physical properties of the core in each of Examples 1 to 3 and Comparative Examples 1 to 8 are as shown in Table 1.

In addition, the golf balls in Examples 1 to 3 and Comparative Examples 1 to 8 were set to be identical to each other in terms of other requirements than those described in Table 1, for example, the arrangement requirement of dimples.

Each of the two-piece golf balls thus produced was then subjected to the following tests. The test items described in Table 1 and the evaluation methods thereof are as follows:

Flying Performance

Each golf ball was hit at a specific point by a hitting robot with its head speed set to a low head speed of 35 m/sec. The flying distance of the ball was measured and evaluated on the basis of the following criterion:

G: total flying distance=156 m or more

FG: total flying distance=more than 155 m and less than 156 m

B: total flying distance=155 m or less

Feeling of Hitting Ball

Each golf ball was hit by 10 amateur golfers with the driver (W#1) and putter, and the feeling of hitting the ball was evaluated by the golfers in accordance with a function evaluation manner based on the following criterion:

G: good soft feeling

FG: slightly hard or slightly hard feeling

B: excessively hard or excessively soft feeling

Durability Against Cracking

Each golf ball was repeatedly hit at random points by the hitting robot with its head speed set to 40 m/s, and the number of initially appeared cracks of the ball was evaluated. The number of initially appeared cracks was expressed by an index based on the number of initially appeared cracks of the golf ball in Example 1, which number was taken as 100. In addition, the hitting of each golf ball was repeated by ten times, and the number of earliest appeared cracks was taken as the number of initially appeared cracks to be evaluated.

G: index=80 or more

B: index=75 or less

TABLE 1

| | Examples | | | Comparative Examples | | | | | | | |
|---|---|---|---|---|---|---|---|---|---|---|---|
| | 1 | 2 | 3 | 1 | 2 | 3 | 4 | 5 | 6 | 7 | 8 |
| Cover | | | | | | | | | | | |
| Composition (Parts by mass) | | | | | | | | | | | |
| Himilan 1557 | 50 | 50 | 50 | 50 | 50 | 50 | 50 | 50 | 50 | 50 | 50 |
| Himilan 1605 | 25 | 25 | 25 | 25 | 25 | 25 | 25 | 25 | 25 | 25 | 25 |
| Himilan 1601 | 25 | 25 | 25 | 25 | 25 | 25 | 25 | 25 | 25 | 25 | 25 |
| Barium sulfate*1 | 22 | 22 | 22 | 22 | 22 | 22 | 22 | 22 | 22 | 22 | 22 |
| Titanium oxide | 5 | 5 | 5 | 5 | 5 | 5 | 5 | 5 | 5 | 5 | 5 |
| Physical properties | | | | | | | | | | | |
| Shore D hardness | 63 | 63 | 63 | 63 | 63 | 63 | 63 | 63 | 63 | 63 | 63 |
| Thickness (mm) | 2.1 | 2.1 | 2.1 | 2.1 | 1.6 | 2.5 | 2.1 | 2.1 | 2.1 | 2.1 | 2.1 |
| Core | | | | | | | | | | | |
| Composition (Parts by mass) | | | | | | | | | | | |
| BR01*2 | 50 | 0 | 50 | 100 | 0 | 50 | 50 | 0 | 50 | 50 | 100 |
| BR11*2 | 50 | 0 | 50 | 0 | 0 | 50 | 50 | 0 | 50 | 50 | 0 |
| BR18*2 | 0 | 100 | 0 | 0 | 100 | 0 | 0 | 100 | 0 | 0 | 0 |
| Zinc acrylate | 22.5 | 23.5 | 24.0 | 25.0 | 23.5 | 25.5 | 24.0 | 23.5 | 27.0 | 21.0 | 19.0 |
| Peroxide(1)*3 | 0.6 | 2.0 | 0.6 | 2.0 | 2.0 | 0.6 | 0.6 | 2.0 | 0.6 | 0.6 | 2.2 |
| Peroxide(2)*4 | 0.6 | 0 | 0.6 | 0 | 0 | 0.6 | 0.6 | 0 | 0.6 | 0.6 | 0 |
| Antioxidant(1)*5 | 0 | 0 | 0 | 0 | 0 | 0 | 0.2 | 0 | 0 | 0 | 0 |
| Antioxidant(2)*6 | 0 | 0.5 | 0 | 0.5 | 0.5 | 0 | 0 | 0.5 | 0 | 0 | 0.5 |
| Barium salfate | 12.1 | 11.9 | 11.4 | 11.2 | 12.1 | 10.5 | 11.4 | 11.9 | 10.0 | 12.8 | 14.3 |
| Zinc oxide | 5 | 5 | 5 | 5 | 5 | 5 | 5 | 5 | 5 | 5 | 5 |
| Zinc salt of pentachlorothiophenol | 0.2 | 0 | 0.2 | 0 | 0 | 0.2 | 0.1 | 0 | 0.2 | 0.2 | 0 |
| Diphenyl disulfide | 0 | 0.5 | 0 | 0 | 0.5 | 0 | 0 | 0.5 | 0 | 0 | 0 |
| Vulcanizing condition | | | | | | | | | | | |
| Primary stage | | | | | | | | | | | |
| Vulcanizing temp (° C.) | 157 | 170 | 157 | 160 | 170 | 157 | 145 | 175 | 157 | 157 | 165 |
| Vulcanizing time (min) | 15 | 20 | 15 | 25 | 20 | 15 | 30 | 30 | 15 | 15 | 30 |
| Secondary stage | | | | | | | | | | | |
| Vulcanizing temp (° C.) | | | | | | | 170 | | | | |
| Vulcanizing time (min) | | | | | | | 10 | | | | |
| Physical properties | | | | | | | | | | | |
| Outside diameter (mm) | 38.5 | 38.5 | 38.5 | 38.5 | 39.5 | 37.7 | 38.5 | 38.5 | 38.5 | 38.5 | 38.5 |
| Weight (g) | 33.6 | 33.6 | 33.6 | 33.6 | 36.3 | 31.5 | 33.6 | 33.6 | 33.6 | 33.6 | 33.6 |
| Compressive deformation amount (mm) | 4.1 | 4.3 | 3.8 | 3.7 | 4.3 | 3.5 | 3.6 | 4.3 | 3.2 | 4.7 | 5.0 |
| Surface hardness*7 | 80 | 78 | 81 | 77 | 78 | 81 | 74 | 81 | 83 | 78 | 69 |
| Center hardness*7 | 56 | 55 | 57 | 56 | 55 | 59 | 66 | 52 | 60 | 55 | 38 |
| Surface hardness – Center hardness*7 | 24 | 23 | 24 | 21 | 23 | 22 | 8 | 29 | 23 | 23 | 31 |

TABLE 1-continued

| | Examples | | | Comparative Examples | | | | | | | |
|---|---|---|---|---|---|---|---|---|---|---|---|
| | 1 | 2 | 3 | 1 | 2 | 3 | 4 | 5 | 6 | 7 | 8 |
| Golf ball | | | | | | | | | | | |
| Physical properties | | | | | | | | | | | |
| Outside diameter (mm) | 42.7 | 42.7 | 42.7 | 42.7 | 42.7 | 42.7 | 42.7 | 42.7 | 42.7 | 42.7 | 42.7 |
| Weight (g) | 45.4 | 45.3 | 45.3 | 45.3 | 45.3 | 45.3 | 45.3 | 45.3 | 45.3 | 45.3 | 45.3 |
| W#1 | | | | | | | | | | | |
| HS = 35 m/s | | | | | | | | | | | |
| Carry (m) | 141.2 | 141.5 | 140.8 | 139.3 | 141.9 | 140.1 | 140.1 | 140.4 | 140.9 | 141.0 | 139.8 |
| Total (m) | 157.3 | 157.8 | 156.6 | 155.0 | 158.3 | 155.3 | 155.3 | 155.4 | 156.1 | 157.2 | 149.8 |
| Spin (rpm) | 3340 | 3240 | 3489 | 3539 | 3310 | 3689 | 3769 | 3201 | 3789 | 3090 | 2940 |
| Evaluation | G | G | G | B | G | FG | FG | FG | G | G | B |
| Feeling | | | | | | | | | | | |
| Driver (W #1) | G | G | G | G | G | G | FG | G | FG | B | B |
| Putter | G | G | G | G | G | B | G | G | B | G | B |
| Durability against cracking | G | G | G | G | B | G | G | B | G | B | B |

*[1]Barium sulfate = settleable barium sulfate 300 (true specific gravity: 4.4, sold by Sakai Chemical Industry Co. Ltd.)
*[2]BR = polybutadiene (trade name: BR01, BR11, BR18, sold by Japan Synthetic Rubber Co.. Ltd.)
*[3]Peroxide(1) = dicumyl peroxide (trade name: Percumyl D, sold by NOF CORPORATION)
*[4]Peroxide(2) = 1,1-bis(t-butylperoxy)3,3,5-trimethylcyclohexane (trade name: Perhexa 3M-40, sold by NOF CORPORATION)
*[5]Antioxidant(1) = Nocrac NS-6 (Ouchi-Sinko Chemical Industrial Co., Ltd.)
*[6]Antioxidant(2) = Yoshinox 425 (Yoshitomi Pharmaceutical Co., Ltd.)
*[7]JIS-C hardness As is apparent from the results shown in Table 1, each of the golf balls in Examples 1 to 3 exhibits the excellent flying performance, feeling of hitting the ball, and durability against cracking.

On the contrary, the golf balls in Comparative Examples 1 to 8 are inferior to the golf balls in Examples 1 to 3 as follows:

In Comparative Example 1, since the core does not contain any organic sulfur compound, both the resilience of the ball and flying performance are poor.

In Comparative Example 2, since the cover gauge is as thin as 1.6 mm, the durability against cracking is poor.

In Comparative Example 3, since the cover gauge is as thick as 2.5 mm, the feeling of hitting the ball with the putter is excessively hard, and both the resilience of the ball and flying performance are slightly poor.

In Comparative Example 4, since the difference in JIS-C hardness between the core surface and the core center is less than 20, the spin of the ball at the time of hitting the ball with the driver (W#1) becomes large to slightly degrade the flying performance, and since the JIS-C hardness of the core center is more than 60, the feeling of hitting the ball with the driver (W#1) is slightly hard.

In Comparative Example 5, since the difference in JIS-C hardness between the core surface and the core center is more than 27, the durability against cracking is poor, and the resilience of the ball is lowered to slightly degrade the flying performance.

In Comparative Example 6, since the compressive deformation amount is smaller than 3.5 mm (that is, the hardness of the entire core is excessively hard), the feeling of hitting the ball is poor.

In Comparative Example 7, since the compressive deformation amount is larger than 4.6 mm (that is, the hardness of the entire core is excessively soft), the feeling of hitting the ball with the driver (W#1) is excessively soft, and the durability against cracking is poor.

In Comparative Example 8, since the core does not contain any organic sulfur compound and the difference in JIS-C hardness between the core surface and the core center is more than 27, the resilience of the ball is lowered to degrade the flying performance, and since the compressive deformation amount of the core is more than 4.6 mm and the hardness of the core center is less than 40 while the hardness of the core surface is less than 70, the feeling of hitting the ball is excessively soft and the durability against cracking is poor.

As a result, it is found that, by adjusting the difference in hardness between the core surface and the core center, the hardness of the entire core (that is, the compressive deformation amount), and the cover gage in the respective ranges specified according to the present invention, and further adjusting the composition of each of the core and cover as described above to thereby desirably adjust the composition of the entire ball, it is possible to provide a golf ball improved in the flying performance of the ball, the feeling of hitting the ball, and the durability against cracking in good balance. In particular, the golf ball of the present invention is suitable for golfers at the level of low/intermediate head speeds. The reason for this is as follows: namely, when such a golfer hits a golf ball with a club having a large loft angle, the spin of the hit ball tends to become large; however, if using the golf ball of the present invention, the golfer makes it possible to prevent the spin of the hit ball from becoming excessively large and hence to increase the flying distance of the ball.

While the preferred embodiments of the present invention have been described using specific terms, such description is for illustrative purpose only, and it is to be understood that changes and variations may be made without departing from the spirit or scope of the following claims.

What is claimed is:

1. A two-piece golf ball comprising a core and a cover, wherein said core is made from a rubber composition containing a base rubber to which an organic sulfur compound is mixed in an amount of 0.05 part by mass or more on the basis of 100 parts by mass of said base rubber;

the JIS-C hardness, measured by a JIS-C hardness tester, of the center of said core is in a range of 40 to 60 and the JIS-C hardness of the surface of said core is in a range of 70 to 85, and further, a difference in JIS-C hardness between the core surface and the core center (hardness of core surface−hardness of core center) is in a range of 20 to 27;

the compressive deformation amount, which is measured by applying, to said core, a load from an initial load of 10 kgf (98.07 N) to a final load of 130 kgf (1274.91 N), is in a range of 3.8 to 4.6 mm; and wherein said cover is made from a material containing a main resin to which an inorganic granular filler is mixed as a reinforcing material in an amount of 11 parts by mass or more on the basis of 100 parts by mass of said main resin, and the thickness of said cover is in a range of 1.8 to 2.3 mm.

2. A two-piece golf ball according to claim 1, wherein said organic sulfur compounds include zinc salts of pentachlorothiophenol, pentafluorothiophenol, pentabromothiophenol, parachlorothiophenol, and pentachlorothiophenol.

3. A two-piece golf bail according to claim 1, wherein said difference in JIS-C hardness between the core surface end the core center is set in a range of 22 to 25.

4. A two-piece golf ball according to claim 1. wherein said cover material include the Zn ion and Na ion neutralized type ionomer resins which are set in a range of 30 mass % or more with the total weight of these ionomer resins taken as 100 respectively.

5. A two-piece golf ball according to claim 1, wherein the average particle size of said inorganic granular filler is set in a range of 0.01 to 100 $\mu$m.

6. A two-piece golf ball according to claim 1, wherein the inorganic granular filler is a barium sulfate.

7. A two-piece golf ball according to claim 1, wherein the ball has a weight of from 45.3 to 45.93 g.

* * * * *